United States Patent [19]

Hasegawa et al.

[11] 4,362,260

[45] Dec. 7, 1982

[54] YARN FEEDING APPARATUS

[75] Inventors: Katsumi Hasegawa, Kusatsu; Takahiro Kawabata, Otsu; Hiroshi Ueda, Shiga, all of Japan

[73] Assignee: Toray Industries, Inc., Tokyo, Japan

[21] Appl. No.: 215,944

[22] Filed: Dec. 12, 1980

[30] Foreign Application Priority Data

Dec. 12, 1979 [JP] Japan ..... 54-160376

[51] Int. Cl.[3] ..... B65H 51/04

[52] U.S. Cl. ..... 226/190; 28/245; 226/193; 242/18 R; 242/35.5 R; 425/66

[58] Field of Search ..... 226/190, 193, 189, 168, 226/169, 91; 242/18 R, 18 DD, 18 PW, 35.5 R, 45, 47.01; 28/245, 246; 57/279; 425/66

[56] References Cited

U.S. PATENT DOCUMENTS

| | | | |
|---|---|---|---|
| 2,181,934 | 12/1939 | Blount | 425/66 |
| 2,182,762 | 12/1939 | Mengeringhausen et al. | 425/66 |
| 2,388,068 | 10/1945 | McDermott | 425/66 X |
| 2,407,730 | 9/1946 | Wethers | 226/190 X |
| 2,468,666 | 4/1949 | Heim | 425/66 |
| 2,855,749 | 10/1958 | Eshuis | 57/279 |
| 3,018,608 | 1/1962 | Kleekamm et al. | 28/246 X |
| 3,093,330 | 6/1963 | Schmidt | 242/45 |
| 4,043,718 | 8/1977 | Takenaka et al. | 28/246 X |
| 4,060,207 | 11/1977 | Miyazaki et al. | 242/18 R |
| 4,185,761 | 1/1980 | Miyazaki et al. | 226/190 X |

*Primary Examiner*—Stanley N. Gilreath

*Attorney, Agent, or Firm*—Jenkins, Coffey, Hyland, Badger & Conard

[57] ABSTRACT

A high speed yarn feeding apparatus for feeding yarn from a yarn supply source to a yarn take-up apparatus is disclosed which is capable of being threaded by conventionally employed suction nozzles. The yarn feeding apparatus employs at least one stepped godet roller having a small diameter portion on which the travelling yarn is initially threaded. A yarn hooking means is provided on the peripheral surface of the stepped side of the large diameter portion of the stepped roller. Means is provided upstream of the stepped roller for shifting the travelling yarn from a position aligned with the small diameter portion to a position aligned with the large diameter portion of the stepped roller. The yarn hooking means can take various conformations and more than one hooking means can be provided on a single stepped godet roller. At least portions of the surface of the small diameter portion of the stepped roller can be configured to lower the frictional forces active on the yarn when in contact with that portion of the surface. The yarn feeding apparatus of the present design can be employed with non-stepped rollers or with a plurality of stepped rollers in either drawing or non-drawing operations. The particular advantages of the yarn feeding apparatus becomes significant where the peripheral speed of the large diameter portion of the stepped roller is equal to or greater than 3,500 m/min. and is particularly successful at speeds of 6,000 m/min. or more.

15 Claims, 10 Drawing Figures

YARN FEEDING APPARATUS

BACKGROUND OF THE INVENTION

1. Field of the Invention

This invention relates to a high-speed yarn feeding apparatus for transferring a synthetic yarn supplied continuously from a yarn supply source to a yarn pickup apparatus.

2. Description of Prior Art

Generally, a synthetic yarn is produced by extruding a polymer such as polyamide and polyester in a molten state from a spinning apparatus to form continuous filaments. The filaments are then cooled and passed through a feeding apparatus to a takeup apparatus which winds the filaments. The feeding apparatus usually comprises at least one positively rotating roller (usually called a godet roller) which contacts and advances the filaments.

An air ejector (usually called a suction nozzle or gun in a factory) is generally employed for threading the yarn filaments from the spinning apparatus through the feeding apparatus to the takeup apparatus. The travelling yarn supplied continuously from the spinning apparatus is sucked and drawn off by the suction nozzle. The yarn is then threaded from the spinning apparatus to the takeup apparatus by a person moving the suction nozzle along a thread line through the feeding apparatus. The feeding apparatus generally consists of one or more positively rotating rollers and several yarn guides positioned in appropriate places. The takeup apparatus typically includes a rotatable tube or bobbin on a winder.

In recent years, the winding speed of the winder has been increased and is typically operated at a speed of about 6,000 meters per minute (m/min) or more. Such a process is disclosed, for example, in U.S. Pat. No. 4,134,882. The increased winding speed of the winder is also reflected by the positive rotating rollers along the thread line. This increased speed causes a particularly difficult problem during the threading operation of the yarn from the spinning apparatus to the takeup apparatus.

If the suction force on the suction nozzle is that which is typical of air ejectors generally employed, the yarn cannot be drawn from the positively rotating roller after the yarn has been introduced to the roller. It is believed that this is principally due to the adhesion of the yarn to the surface of the roller and/or to the accompanying air stream generated around the roller by its rotation. This causes a yarn rolling-in or wrap-up on the roller which in turn prevents any further threading of the yarn. The difficulty in the threading operation becomes greater as the yarn transfer speed on the positively rotating roller becomes higher and the volume of the yarn becomes greater hence requiring an even greater suction to draw off the yarn from the roller.

Employing even the best commercially available suction nozzles under optimum conditions permits the threading of yarn having a travelling speed of at most about 3,500 to 4,000 m/min.

In Japanese Patent Publication No. 49778/72, a very high performance suction nozzle has been proposed which requires the use of a pressure chamber of very large capacity and compressed air of a very high pressure in order to maintain the high suction force. In use, however, this high performance suction nozzle has the following problems: (A) worsening of the work environment due to extremely loud noise generation upon release of the compressed air; (B) consumption of the compressed air at a great rate making continuous yarn threading operation uneconomical; (C) even the slightest drop in the suction force leads to a failure in the yarn threading operation; and (D) in the event of such failure, one must wait until the pressure recovers in the pressure chamber before again attempting the yarn threading operation. During this wait, waste yarn is generated in great quantities.

Japanese Patent laid-open Number 8111/77 discloses a method of winding high speed spun yarn which includes a stepped roller as a yarn feeding apparatus. The yarn passes through a small diameter portion of the stepped roller at the time of the yarn threading operation so that the tension of the travelling yarn between the positively rotating roller and the winder is maintained higher than the tension at the time of normal winding, thus increasing the success rate for threading the yarn to the winder. After threading the yarn to the winder, the travelling yarn is moved from the small diametered portion to the large diametered portion of the roller by a yarn shifting guide. This method was developed with the object of increasing the efficiency and success of threading to a winder. The disclosed stepped roller has only a small difference in diameter between the large diametered portion and the small diametered portion. If the difference in diameter is increased, the travelling yarn cannot be moved from the small diametered portion to the large diametered portion by the yarn shifting guide because of the large gap in height between the surfaces of the two portions of the stepped roller.

SUMMARY OF THE INVENTION

It is an object of the present invention to provide a yarn feeding apparatus for transferring a synthetic yarn at high speed in a normal feeding operation between a yarn supply source and a yarn take-up apparatus in which the disadvantages previously described are overcome. An advantage of the present invention is that it is able to carry out the threading of the yarn from the yarn supply to the yarn takeup apparatus through the yarn feeding apparatus employing merely a conventional commercially available suction nozzle.

The features of the present invention provide a yarn feeding apparatus for transferring, or transferring and drawing, a synthetic freshly spun yarn supplied continuously from a spinning apparatus to a yarn winder at high speed in normal feeding operation. Other objects, features, and advantages of the present invention will become apparent to those having ordinary skill in the art upon consideration of the remaining disclosure.

According to the invention, the yarn feeding apparatus comprises a stepped roller positively rotated by a driving means. The stepped roller has a small diameter portion which contacts the yarn during the threading operation and a large diameter portion which contacts the travelling yarn during the normal feeding of the yarn. The stepped roller further includes a yarn hooking means at the peripheral surface edge of the large diameter portion on the stepped side. Means is provided on the upstream side of the stepped roller for shifting the position of the yarn with respect to the surface of the stepped roller. The shifting means positions the thread line to the small diameter portion during threading operation and changes the thread line to the large diameter portion after threading of the yarn is finished.

The yarn hooking means provided at the peripheral surface edge of the large diameter portion on the stepped side of the roller can be formed by a grooved portion formed in the stepped side of the large diameter portion or can be formed by a projected portion extending outwardly on the stepped edge of the large diameter portion. When the line from the upstream side of the stepped roller moves from the small diameter portion to the large diameter portion, the travelling yarn touches the peripheral surface edge of the stepped side of the large diameter portion. The travelling yarn is then caught by the yarn hooking means during the rotation of the stepped roller. Once the yarn is caught by the yarn hooking means, the yarn mounts onto the surface of the large diameter portion during the subsequent single rotation of the stepped roller.

Preferably, the edge of the step is perpendicular to the axis of the roller, or the edge portion of the surface of the large diameter portion on the stepped side forms an overhang over the surface of the small diameter portion, thus facilitating the catching of the yarn by the yarn hooking means. It is also preferable that two or more yarn hooking means are provided on the stepped edge where the diameter of the large diameter portion is very large.

The diameter of the large diameter portion of the stepped roller is selected as a function of the rotational frequency of the roller to achieve the desired peripheral speed. In general, it is preferable that the diameter be selected in the range of from about 150 to about 300 mm. This range is believed to be optimum based upon considerations of the contact angle and contact length of the yarn to the peripheral surface for giving a suitable transferring force to the yarn on the large diameter portion.

The stepped roller can be made of the material used for conventional godet rollers such as steel, for example, S45C Japanese Industrial Standard. It is preferable that the surface of the small diameter portion be finished with a fine dotted surface often called a pebbly surface finish. Alternatively, the surface may be a finely slitted surface with the direction of the slits intersecting the direction of the thread line on the surface, that is, substantially parallel to the direction of the axis of the roller. These surface finishes make the surface of the small diameter portion somewhat slippery to the yarn travelling on the surface so as to make it easier to draw the yarn from the small diameter portion with the aid of the conventional suction nozzle.

The ratio of the peripheral speed of the large diameter portion to the peripheral speed of the small diameter portion is preferably selected in the range of from about 1.5:1 to about 5:1 according to conditions of yarn speed, ability of suction nozzle etc. The concept of the invention is applicable to the feeding of a travelling yarn even at low speed; however, the merit of the invention is obtained more clearly on a yarn feeding apparatus which transfers the yarn with a speed of not less than 3,500 m/min.

The yarn feeding apparatus according to the present invention is preferably used in combination with any well known spinning apparatus of synthetic polymers such as polyamide and polyester since the speed of the yarn emanated from the spinning apparatus is capable of being changed automatically over a comparatively wide range. The yarn may be drawn from the spinning apparatus at a comparatively low speed during the threading of the yarn under the influence of a suction nozzle and then be changed automatically to a very high transfer speed for normal feeding of the yarn to the winder.

The yarn feeding apparatus according to the present invention can also be used in a drawing system of a freshly spun yarn to perform in orientation of the molecules in the yarn. In such a situation, usually two rollers having different peripheral speeds are used in the feeding apparatus. The first roller in an upstream position has a lower peripheral speed than a second roller in a downstream position. Where the peripheral speed of the first roller is comparatively low, it is possible to use a normal non-stepped roller. A stepped roller having a configuration according to the present invention is employed as the second roller having a higher peripheral speed than the first roller together with a yarn shifting means to further practice the invention. On the other hand, where the peripheral speed of the first roller is comparatively high, the stepped roller of the present invention is used as both the first and the second rollers with the second roller having a higher peripheral speed than the first roller and the yarn shifting means being positioned before the first roller. In this case, a second yarn shifting means needs not be positioned before the second stepped roller.

A yarn shifting means for shifting the travelling yarn position itself is well known in the textile field. One representative prior art yarn guide holds the yarn at a first position until a shift is desired. Then, the yarn guide itself moves to the other position together with the travelling yarn. In yet another system well known in the prior art, a first stationary yarn guide holds the travelling yarn at one position. When it is desired to shift the travelling yarn, the first yarn guide simply releases the travelling yarn and a second stationary yarn guide positioned at the expected position catches the travelling yarn released from the first yarn guide, the yarn being moved from the first to the second yarn guide according to the tension balancing of the travelling yarn.

Additional features of the previously summarized invention will become apparent to those skilled in the art upon consideration of the following description of preferred embodiments of the invention together with the accompanying figures.

DESCRIPTION OF PREFERRED EMBODIMENTS

Figure 1:
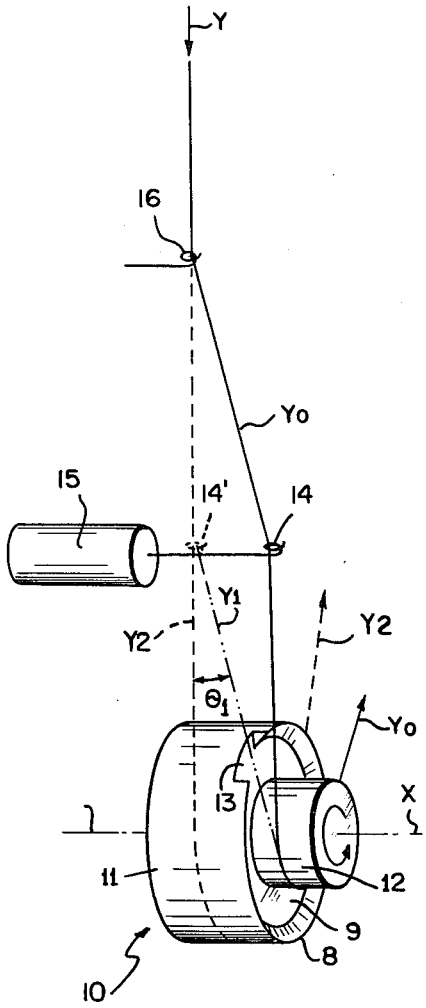
FIG. 1 is a schematic perspective view of one embodiment of the yarn feeding apparatus of the present invention.

A first embodiment of the present invention is illustrated schematically in the perspective view of FIG. 1. A yarn feeding apparatus includes a stepped roller 10 which comprises a large diameter portion 11 and a small diameter portion 12 with a yarn hooking means 13 disposed on the peripheral surface edge 8 on the stepped side 9 of the large diameter portion. Yarn Y is delivered from a yarn source (not shown in FIG. 1) and is threaded by a person using a conventional suction nozzle through the stationary yarn guide 16. The yarn is then threaded through the yarn shifting guide 15, around the small diameter portion 12 of the stepped roller 10, and then to a yarn takeup apparatus (not shown in FIG. 1). The yarn path during the threading operation is represented by the symbol $Y_0$. The yarn shifting guide 15 provided on the upstream side of the stepped roller 10 is designed to move along the direction of the axis of the stepped roller 10 from the position 14 to the position 14'.

While the yarn hooking means 13 shown in FIG. 1 is composed of a grooved portion formed by cutting off a part of a cylindrical circumferential surface on the large diameter portion 11 of stepped roller 10, as shown in FIG. 3, the yarn hooking means 13 can be a pin protruding from peripheral surface edge 8 and over the small diameter portion 12. A discussion of the various shapes for the yarn hooking means 13 is provided later in this specification. In general, the yarn hooking means 13 must have a configuration so as to perform the intended function, namely, that when the yarn shifting guide 15 moves to the left, as shown in FIG. 1, to position 14', the yarn hooking means 13 picks up the yarn Y and delivers it onto the large diameter portion 11 of the stepped roller 10 with the next rotation of stepped roller.

A thorough understanding of this operation may be gained by considering the three yarn paths illustrated in FIG. 1, $Y_0$, $Y_1$, and $Y_2$. As indicated previously, the yarn Y is initially threaded to assume the yarn path $Y_0$ which is represented by the solid line in FIG. 1. When the yarn shifting guide 15 moves from the position represented by the numeral 14 to the position indicated by the numeral 14', the yarn Y assumes the path $Y_1$ extending from the position of the yarn shifting guide 14' to the small diameter portion 12 of stepped roller 10. This yarn path $Y_1$ has an angle $\theta_1$ relative to the yarn path $Y_2$ which is at right angles relative to the axis of rotation X of stepped roller 10.

Since the yarn entering the roller 10 generally has a tendency to move such that the angle $\theta_1$ approaches zero thereby balancing the tension on the yarn, in this case, the yarn Y moves leftwardly on the smaller diameter portion 12 and approaches the large diameter portion 11. As the yarn path $Y_1$ moves leftward, the yarn path $Y_1$ comes into contact with the edge portion 8 of the large diameter portion 11 on the stepped side 9. The yarn is then caught in the groove or other configuration of the yarn hooking means 13 formed on edge portion 8. As the stepped roller 10 continues to rotate, the yarn Y located upstream of the yarn hooking means 13 rolls up on the surface of the large diameter portion 11 of the stepped roller 10. The yarn Y located downstream relative to the yarn hooking means 13 gradually comes off the surface of the small diameter portion 12 during this same rotation of stepped roller 10. Once the stepped roller 10 has completed one rotation, the yarn path is fully on the surface of the large diameter portion 11 and the yarn continues to move leftward so as to minimize the yarn tension, the yarn tension minimum occurring when $\theta_1$ becomes zero which is illustrated as yarn path $Y_2$.

Figure 2:
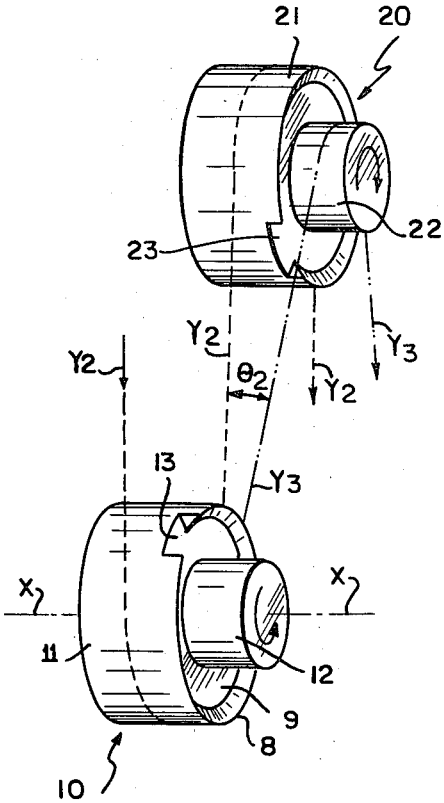
FIG. 2 is a schematic perspective view of another embodiment of the yarn feeding apparatus of the present invention.
Figure 3A:
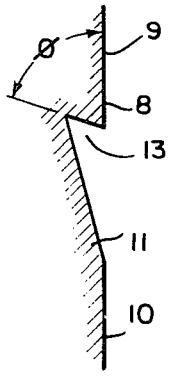
FIGS. 3(*a*) through (*d*) illustrate partial side views of four different preferred stepped roller configurations for the yarn hooking means of the present invention.
Figure 3B:
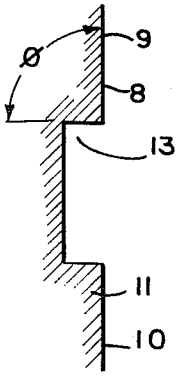
Figure 3C:
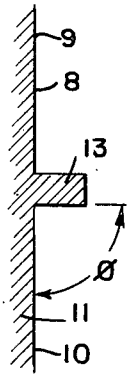
Figure 3D:
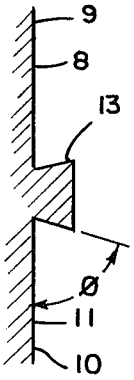

A second embodiment of the present invention is illustrated schematically in FIG. 2 wherein a yarn feeding apparatus similar to that illustrated in FIG. 1 further comprises a second stepped roller 20. While FIG. 2 does not specifically illustrate the stationary guide 16 and the yarn shifting guide 14 of FIG. 1, this omission is merely for simplicity and is not intended to suggest that the elements are necessarily absent from the second embodiment. Further, the stepped roller 10 illustrated in FIG. 2 is presumed to function same as stepped roller 10 in FIG. 1. The second stepped roller 20 has a configuration similar to that of stepped roller 10 and includes a small diameter portion 22, large diameter portion 21, and yarn hooking means 23. Where the peripheral speed of large diameter portion 11 of first roller 10 is lower than the peripheral speed of the large diameter portion 21 of the second stepped roller 20, a drawing operation on the travelling yarn Y is accomplished between the first and second stepped rollers 10 and 20. Where no such drawing operation is desired, the peripheral speeds of corresponding portions of the two rollers 10 and 20 are maintained approximately equal.

When the yarn Y is initially situated on rollers 10 and 20 with the aid of a suction gun apparatus (not illustrated), the yarn Y is located on small diameter portions 12 and 22 of rollers 10 and 20 respectively. Actuation of yarn shifting guide 15 from position 14 to position 14' as previously discussed with respect to FIG. 1 moves the yarn Y from small diameter portion 12 to large diameter portion 11 of roller 10 as previously described in connection with FIG. 1. When the yarn has completed this shift to assume yarn path $Y_2$ as illustrated in FIG. 1, the yarn still initially passes over small diameter portion 22 of roller 20 in the path illustrated in FIG. 2 as $Y_3$.

The yarn path $Y_3$ is again at an angle $\theta_2$ relative to the normal yarn path $Y_2$, and thus the small phenomenon which was observed with respect to roller 10 occurs with respect to roller 20. That is, the yarn Y shifts to the left on small diameter portion 22 of roller 20 until the yarn is caught by the yarn hooking means 23 of roller 20. As roller 20 continues to rotate, the yarn is transferred from the small diameter portion 22 to the large diameter portion 21 and moves toward the yarn path illustrated as $Y_2$, the angle $\theta_2$ approaching zero as the yarn tension is minimized. It will be appreciated from this that a yarn shifting guide is not required between roller 10 and roller 20. Rather, the shift of yarn guide 15 from position 14 to position 14' directly is followed by a sequential shift of the yarn from small diameter portion 12 to large diameter portion 11 of roller 10 and then subsequently by a shift of the yarn from small diameter portion 22 to large diameter portion 21 of roller 20.

FIG. 3 shows a few partial side views of stepped rollers according to the present invention. FIGS. 3*a* and 3*b* illustrate an indentation or groove in the peripheral edge 8 of stepped portion 9 to form the yarn hooking means 13. FIGS. 3*c* and 3*d* show stepped rollers according to the present invention having a projected portion on the periphery 8 of stepped edge 9 of the large diameter portion 11 which would overlie the small diameter portion 12. It is preferable that the angle $\phi$ shown in FIG. 3 is selected in the range of from 30 to 100 degrees. In either case, the yarn hooking function is improved when the angle $\phi$ is an acute angle. Where the angle $\phi$ is an acute angle, the depth of the groove and/or the height of the projection employed to create the yarn hooking means 13 can be reduced although the minimum dimension of the hooking means is believed to be a medium percentage, i.e., about 50% of the cross section of the yarn being handled by the apparatus.

Figure 4:
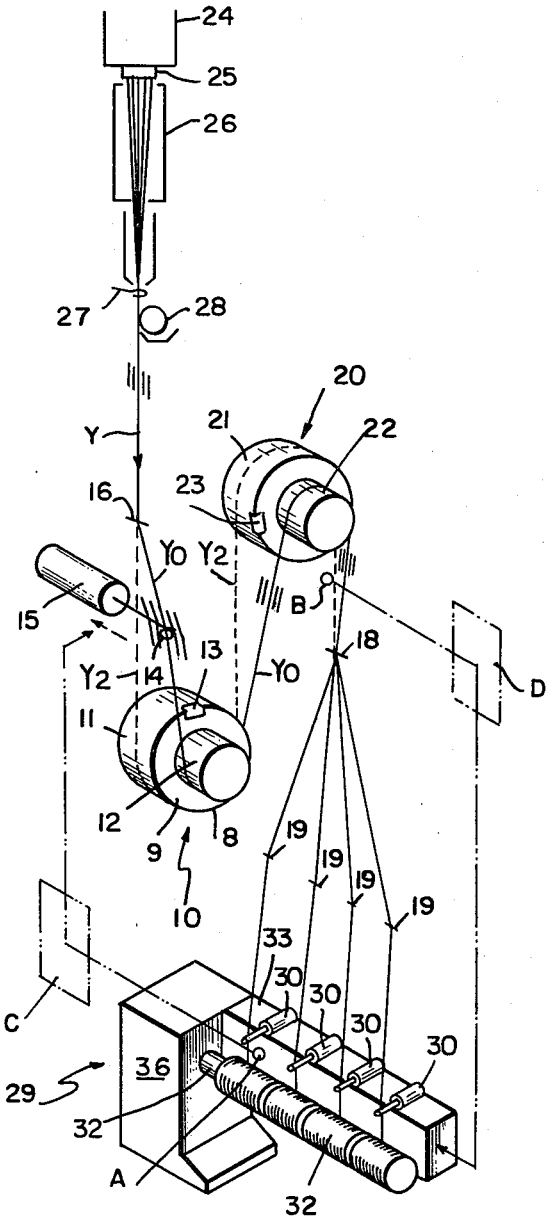
FIG. 4 is a schematic perspective view of a freshly spun yarn winding system employing a yarn feeding apparatus constructed in accordance with the present invention.

A third embodiment of the present invention is illustrated in FIG. 4 which shows an example of a freshly spun yarn winding system in which the yarn feeding apparatus of the present invention is employed. In this system, a molton polymer is extruded from a spinneret 25 provided in a spinning apparatus 24 to form filaments which make up the yarn Y. The filaments extruded from the spinneret are cooled as they pass through a cooling chimney 26 and are gathered into four separated groups or strands on a stationary yarn guide 27. Each of the strands is composed of one-fourth of the total number of filaments extruded from the spinneret 25.

A yarn Y composed of the four separated strands travels downwards and is oiled by contacting an oiling roller 28. A yarn feeding apparatus according to the present invention including a pair of stepped rollers is positioned downstream of the oiling roller 28. The yarn feeding apparatus is constructed in accordance with the principles illustrated and discussed previously with respect to FIGS. 1 and 2.

The yarn emanating from the yarn feeding apparatus passes through stationary yarn guide 18 and is there separated into the four individual strands. Each of the strands then travels through another stationary guide 19 to a winding apparatus 29.

The winding apparatus 29 is a well known four-bobbin spindle drive winder which includes a spindle 31 positively driven by a driving means 36. Four bobbins 32 are mounted on the spindle 31 and are separable from each other. Four yarn traverse means (behind the bobbins 32) are disposed adjacent to each of the bobbins 32 and are connected to a traverse mechanism 33. Four retractable yarn guides 30 are provided to engage each of the strands prior to the introduction of the strand to the yarn traverse means. Four setting yarn guides (behind the bobbins 32) engage the strands and cause the same to be manipulated by the traverse mechanism 33.

The symbol A in FIG. 4 represents a yarn hooking detector which detects the completion of the yarn threading operation to each of the setting yarn guides in the winding apparatus 29. When the signal from A is delievered to a controller C, the signal controls the position of the yarn shifting guide 15. Symbol B in FIG. 4 represents a yarn path detector. When the signal of this detector B is delivered to controller D, the signal controls the position of the retractable yarn guides 30.

In operation, the large diameter portions 11 and 21 of stepped rollers 10 and 20 respectively are adjusted to have a surface speed of 6,000 m/min. The surface speed of bobbins 32 are likewise set to 6,000 m/min. In this embodiment, neither drawing nor stretching of the yarn occurs between the first and second step rollers 10 and 20 since both rollers have the same peripheral speed. The ratio of the diameters of the large and small diameter portions of both stepped rollers 10 and 20 are set at 2:1 in this embodiment. The yarn shifting guide 15 is set in the position 14 illustrated so as to be aligned with the small diameter portion 12 of the first stepped roller 10 while the retractable yarn guides 30 are positioned in a projected position.

The spinning of the filaments from spinneret 25 is then initiated. The yarn travels downwards from the spinneret 25 as previously discussed and is sucked and drawn off by a conventional suction nozzle (not shown in FIG. 4) handled by a person in the usual manner beginning just upstream of stationary yarn guide 27. The yarn is threaded on the stationary yarn guide 27 and also onto the oiling roller 28. The yarn Y is then threaded onto stationary guide 16 and onto shifting yarn guide 15 which is positioned at location 14 in line with the small diameter portion 12 of the first stepped roller 10. From there, the yarn is directed around the smaller diameter portions 12 and 22 of rollers 10 and 20 respectively and onto stationary yarn guide 18 in the usual manner still employing the conventional suction nozzle. Thereafter, the yarn is separated into four strands or strand groups and directed through stationary yarn guides 19 to the retractable yarn guides 30. Each of the strands then is directed to the setting yarn guides which, with the retractable yarn guides in the projected position, are outside of the traverse range of each of the traverse means installed on the traverse mechanism 33. As each of the setting yarn guides causes the respective strand to touch the surface of the corresponding bobbin 32, the bobbin 32 catches the strand by conventional means. With the retractable yarn guides 30 in the projected position, the yarn does not enter the traverse zone of winding apparatus 29 and is thus wound in a bunch at the end portion of each of the bobbins 32.

When the yarn hooking detector A detects the completion of the yarn hooking, its signal is delievered to the controller C whereupon the controller C transmits the signal to yarn shifting guide 15. The yarn shifting guide 15 is operated and moves the yarn guide from the position 14 which aligned with the small diameter portion 12 of roller 10 to a position 14' aligned with the large diameter portion 11 of roller 10. By moving the yarn shifting guide 15 to the new position, the yarn path is changed from yarn path $Y_0$ to the yarn path $Y_2$ as explained above with respect to FIGS. 1 and 2.

The yarn path detector B detects the completion of the movement of the yarn from path $Y_0$ to $Y_2$. A signal is then delivered to the controller D whereupon the controller moves the retractable yarn guides 30 backward by a suitable means such as a solenoid. The four strand groups are thereupon permitted to enter into the operational zone of the traverse mechanism 33 from the position of the bunch winding and the normal winding operation on the four bobbins 32 is thus initiated.

The yarn hooking detector A and the yarn path detector B preferably comprise reflecting photoelectric sensors such as are commercially available from Optron, Inc. The use of such sensors is well known in the textile processing industry. See, for example, "Using Method of Element of Automation for Saving Labour," page 150, FIG. 4.48, published on Dec. 25, 1971 by Nikkan Kogyo Shinbun-sha, of Tokyo, Japan.

In a yarn feeding apparatus in accordance with the present invention, the yarn threading operation is performed at a low travelling speed of the yarn and the normal operation of winding at high speed is initiated when the yarn threading operation is completed. Even when the yarn is being wound at speeds of 6,000 m/min. or greater, the yarn threading operation is performed at yarn speeds of 3,000 m/min. thus permitting the use of conventional ordinary type suction nozzles to achieve the threading. In addition, the movement of the yarn from the original threaded yarn path $Y_0$ to the high speed winding yarn path $Y_2$ can be accomplished within a short period of time, typically for about 0.2 to about 0.5 seconds.

By way of example, when a 75 denier yarn is to be wound on the bobbins 32 of FIG. 4, the quantity of yarn wound in the bunching mode from the completion of the yarn threading until the start of normal winding is typically about 0.2 to 0.4 grams. This small amount of waste yarn can easily be handled after the bobbin is filled. With a yarn of this size, the movement of the yarn path from $Y_0$ to the position where the yarn is just rolled up on the large diameter portion is automatically performed within about 0.1 seconds.

Figure 5A:
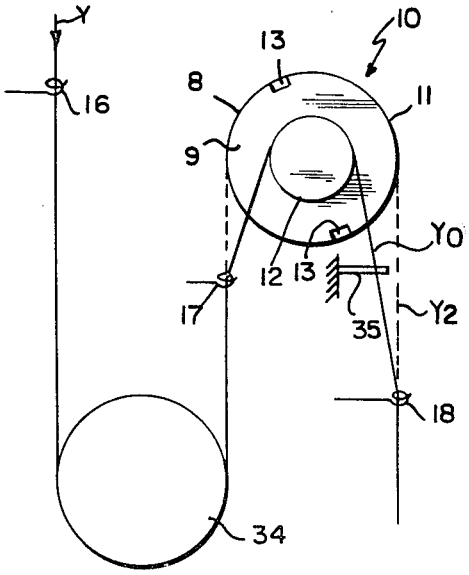
FIG. 5(*a*) is a schematic illustration of a front view of one embodiment of a yarn feeding apparatus in accordance with the present invention, while FIGS. 5(*b*) and 5(*c*) schematically illustrate partial side views of other embodiments of a yarn feeding apparatus in accordance with the present invention.
Figure 5B:
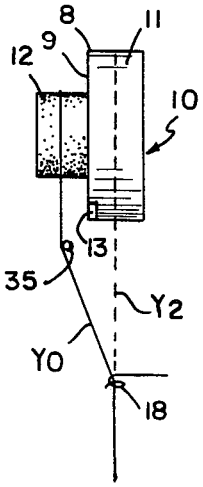
Figure 5C:
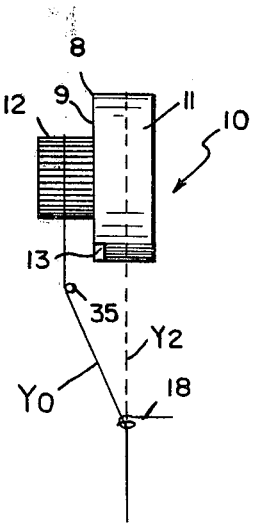

FIG. 5 illustrates yet another embodiment of the present invention and focuses particularly on those situations where the distance between the stepped roller 20 and the stationary yarn guide 18 of FIG. 4 is small. The stationary yarn guide 18 is typically positioned so as to be aligned with yarn path $Y_2$, that is the yarn path passes over the large diameter portion 21 of roller 20. When the yarn is initially positioned in yarn path $Y_0$ over smaller diameter portion 22 of roller 20, the non-alignment with stationary yarn guide 18 can cause the yarn to move toward the stepped portion of roller 20. Upon occasion, the yarn can be caught by the yarn hooking means 23 of stepped roller 20 thus causing the yarn to be prematurely moved from the small diameter portion 22 to the large diameter portion 21 of roller 20.

Inorder to prevent this, there is provided a yarn path regulating guide 35 as illustrated in FIGS. 5*a* and 5*b*.

The yarn path regulating guide 35 is positioned on the downstream side of the stepped roller indicated in FIG. 5 to be stepped roller 10 but prior to the fixed yarn guide 18. The yarn path regulating guide 35 is aligned with the initial yarn path $Y_0$ such that when the yarn is placed in yarn path $Y_0$, the guide 35 comes in contact with the yarn and prevents it from coming in contact with the stepped portion of roller 10. As the yarn moves from yarn path $Y_0$ to yarn path $Y_2$ by being engaged with yarn hooking means 13, the increase in radial position from the narrow diameter portion 12 to the larger diameter portion 11 causes the yarn to become disengaged from the regulating guide 35. This operation can be seen by observing the two paths $Y_0$ and $Y_2$ as illustrated in FIGS. 5*a* and 5*b*.

FIG. 5 further illustrates other embodiments of the present invention in that it includes a normal non-stepped roller 34 which is the first roller of the yarn feeding means prior to the stepped roller 10. The stepped roller 10 acts as the second roller of the yarn feeding apparatus. The small diameter portion 12 of stepped roller 10 is illustrated to have a pebbly surface so as to permit the yarn to slip with respect to that surface. The pebbly surface consists of minute rounded hills and valleys on all portions of the small diameter portion coming in contact with the yarn, and this effects can be obtained by sand blasting, blasting the surface with liquid particles, or etching. The peripheral speed of the large diameter portion 11 of stepped roller 10 is intended to be higher than the peripheral speed of the first roller 34 so that once the yarn assumes yarn path $Y_2$, a drawing or stretching of the yarn occurs. Where the peripheral speed of roller 34 is not more than about 4,000 m/min., there is no need for the use of a stepped roller to permit the threading operation to occur using conventional suction guns. In the embodiment shown in FIG. 5, where drawing or stretching of the yarn is intended, the peripheral speed of roller 34 is not more than 4,000 m/min. while the peripheral speed of the large diameter portion 11 of second roller 10 is not less than 4,000 m/min. Further, note that the second roller 10 incorporates a pair of yarn hooking means 13 located diametrically opposite each other on the peripheral edge 8 of stepped surface 9 of roller 10. In general, any number of yarn hooking means may be employed.

Many advantages are observed by employing the yarn feeding apparatus constructed in accordance with the present invention. Since the threading of the yarn feeding apparatus of the present invention is performed at low speed, the travelling yarn being threaded through the small diameter portions of the yarn feeding apparatus to the bobbin of the yarn winding apparatus, the yarn threading operation is found to be simplified. Further, the ordinary conventional suction nozzle can be employed for this yarn threading operation which results in a smaller consumption of pressurized air and lower noise than with the high pressure systems, thus improving the work environment. It has been found that the installation expenses as well as the operational costs are less with the present invention since the pressurized air generation installation need not be as large as with the high pressure suction nozzles thus minimizing the floor space requirement for such equipment. In operation, it has been observed that the time required for the yarn threading operation is shorter, and there is less occurrence of waste yarn. This results in an improved threading operation efficiency over the conventional high-speed yarn feeding apparatus and is believed to result directly from the yarn hooking means being provided on the stepped edge of the large diameter portion of the stepped roller. While the foregoing description of preferred embodiments is intended as illustrative of the invention, other embodiments of the present invention are believed possible which are still within the spirit of the invention as previously summarized and as defined by the following claims.

What is claimed is:

1. A yarn feeding apparatus for transferring a continuously supplied yarn from a yarn supply source to a yarn takeup apparatus, the yarn feeding apparatus comprising:

(a) a stepped roller comprising
  (i) a small diameter portion for initially receiving the yarn during a threading operation of the yarn from the yarn supply source to the yarn takeup apparatus,
  (ii) a large diameter portion for supporting the travelling yarn during the normal feeding of the yarn through the yarn feeding apparatus, and
  (iii) yarn hooking means on the peripheral surface of the stepped side of the large diameter portion for hooking the yarn to assist in the transfer of the yarn from the small diameter portion to the large diameter portion, (b) driving means for positively rotating the stepped roller, and (c) means on the upstream side of the stepped roller for shifting the travelling yarn position from a position aligned with the small diameter portion to a position aligned with the large diameter portion.

2. The yarn feeding apparatus of claim 1 wherein said yarn hooking means comprises a grooved portion in the peripheral surface edge of the stepped side of the large diameter portion of the stepped roller.

3. The yarn feeding apparatus of claim 1 wherein said yarn hooking means comprises a projected portion on the peripheral surface edge of the stepped side of the large diameter portion overlying the small diameter portion.

4. The yarn feeding apparatus of claim 1 wherein at least a portion of the peripheral surface of the small diameter portion of the stepped roller includes a pebbly surface whereby said portion of the surface is slippery with respect to the travelling yarn.

5. The yarn feeding apparatus of claim 1 wherein at least a portion of the peripheral surface of the small diameter portion of the stepped roller includes a finely slitted surface whereby said portion of the surface is slippery with respect to the travelling yarn.

6. The yarn feeding apparatus of claim 1 wherein the diameter of the large diameter portion and the diameter of the small diameter portion are such that the peripheral speed of the large diameter portion is in the range of from about 1.5 to about 5 times higher than the peripheral speed of the small diameter portion.

7. The yarn feeding apparatus of claim 6 wherein the peripheral speed of the large diameter portion is not less than 3,500 m/min.

8. The yarn feeding apparatus of claim 6 wherein the peripheral speed of the small diameter portion is not more than 4,000 m/min.

9. The yarn feeding apparatus of claim 1 further comprising a yarn path regulating guide on the downstream side of and aligned with the small diameter portion of the stepped roller.

10. The yarn feeding apparatus of claim 1 wherein the stepped roller has more than one of said yarn hooking means on the periphery of the large diameter portion.

11. The yarn feeding apparatus of claim 1 further comprising a second stepped roller on the downstream side of the first stepped roller, the second stepped roller having a large diameter portion and a small diameter portion aligned with the large diameter portion and small diameter portion of the first roller respectively, and a yarn hooking means on the peripheral surface edge of the stepped side of the large diameter portion, and means connecting the second roller to said driving means for positively rotating the second stepped roller at a peripheral speed greater than that of the first stepped roller whereby the yarn is drawn between the two stepped rollers during the normal feeding of the yarn.

12. The yarn feeding apparatus of claim 1 further comprising a non-stepped roller having a peripheral speed of not more than about 4,000 m/min arranged at the upstream side of said stepped roller, the peripheral speed of the large diameter portion of the stepped roller being greater than that of the non-stepped roller during normal feeding operation.

13. The yarn feeding apparatus of claim 1 wherein said yarn hooking means comprises a surface positioned at an angle in the range of from 30 to 100 degrees with respect to the stepped surface of the stepped roller.

14. The yarn feeding apparatus of claim 13 wherein the angle is an acute angle.

15. The yarn feeding apparatus of claim 1 wherein said yarn hooking means comprises a hooking surface having a linear dimension of at least 50% of the mean cross section of the yarn being fed by the yarn feeding apparatus.

* * * * *